United States Patent [19]

Jones

[11] 3,948,016

[45] Apr. 6, 1976

[54] METHOD OF WRAPPING BALES OF STAPLE FIBER

[75] Inventor: Bobby Gene Jones, Columbia, S.C.

[73] Assignee: Allied Chemical Corporation, Petersburg, Va.

[22] Filed: Oct. 1, 1974

[21] Appl. No.: 510,931

[52] U.S. Cl. ..... 53/24

[51] Int. Cl.[2] ..... B65B 1/24

[58] Field of Search ..... 53/24

[56] References Cited

UNITED STATES PATENTS 3,733,769 5/1973 Van Doorn ..... 53/24

OTHER PUBLICATIONS

McCormick, Def. Pub. of Serial No. 104,058, filed Jan. 5, 1971, Def. Pub. No. T893,007.

*Primary Examiner*—Travis S. McGehee

*Attorney, Agent, or Firm*—Richard A. Anderson

[57] ABSTRACT

Before the ram is released, the end flaps of the bale wrap are wrapped around the loose bale wires and pinned in such a manner that the wire wrapped is bowed. When the ram is released, the end flaps are drawn extremely tight against the bale by the now taut but formerly bowed wire. This eliminates the need for sewing or other fastening.

5 Claims, 6 Drawing Figures

METHOD OF WRAPPING BALES OF STAPLE FIBER

BACKGROUND OF THE INVENTION

This invention relates to an improved method of wrapping bales of staple fiber.

Presses for the baling of fibers such as cotton and synthetic fibers which have been chopped into staple are known and disclosed in many patents such as U.S. Pat. No. 3,252,409, hereby incorporated by reference in toto.

In the prior art, the overlapping end flaps of the bale wrap were left loose after the bale was wrapped. This required sewing or other fastening of the overlapping end flaps. Bales were damaged in transit due to end flaps coming loose and fiber being exposed to the elements. Cutting away the twine-sewed end of the bale sometimes was done by hacking with large knives, creating a safety hazard. Often the cut twine used to sew the wrap fell into the staple fiber being processed and contaminated it.

In the prior art, the method of wrapping a bale of staple fiber comprised, dressing the ram head with bale wrap while the bale press chamber is empty, covering the platen with bale wrap while the bale press chamber is empty, the ram head and the platen being covered with sufficient bale wrap to overlap and cover the entire bale and positioned to do so, loading and tamping staple fiber into the bale press chamber, pressing the loaded, tamped staple with the ram to compress it into a bale, covering the remaining sides of the bale, with bale wrap leaving overlapping end flaps of bale wrap, wrapping the covered bale with multiple wires, joining the wires, so that each wire encircles the bale in a loose manner, and releasing the ram.

SUMMARY OF THE INVENTION

The improvement of this invention comprises, before the baling ram is released, securing each of the bale wrap overlapping end flaps around one of the loose, multiple, joined, encircling wires to bow the wire, so that the wire straightens out on release of the ram to exert tension on the overlapping end flaps of the bale wrap, thereby eliminating the need to fasten the overlapping end flaps of bale wrap. Preferably, the bale wrap overlapping end flaps are each secured around one of the multiple encircling wires near each end of the bale to bow the wire by pinning the wrap with a pinning means. The preferable pinning means is an awl. Preferably, the wires encircle the bale transverse to the longest dimension of the bale.

When the ram is released after the end flaps have been secured according to this invention, the end flaps are drawn extremely tight against the bale by the now taut but formerly bowed wire. This eliminates the need for sewing or other fastening. The new bale is less likely to be damaged in transit than the loose or sewed flap bales. Cutting or removing the twine used in sewing is no longer necessary by the end user. This saves time, eliminates the contamination problem and eliminates the safety hazard. The staple packaged into a bale by this method can be any commonly known natural or synthetic staple fiber, such as cotton, wool, nylon, polyester, polypropylene, and the like. The staple fiber is useful when processed into textiles or other fabrics sucn as carpets or upholstery.

The bale wrap may be any of the known wrapping fabrics, such as burlap or other cheap, tough, natural or synthetic wrapping fabrics which could be made from cotton, hemp, other natural fibers or synthetic fibers such as polyethylene, polypropylene, or nylon and the like.

DESCRIPTION OF THE PREFERRED EMBODIMENTS

Figure 1:
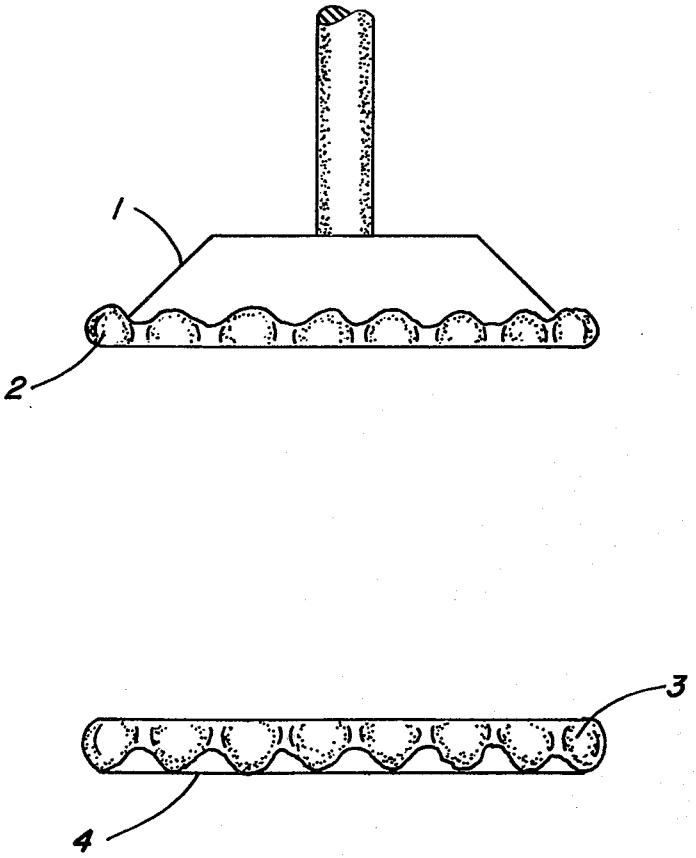

FIG. 1 is a schematic of the first steps of the method of this invention showing ram head 1 dressed with bale wrap 2 and platen 4 covered with bale wrap 3.

Like numbers indicate like elements in each of the schematic drawings.

Figure 2:
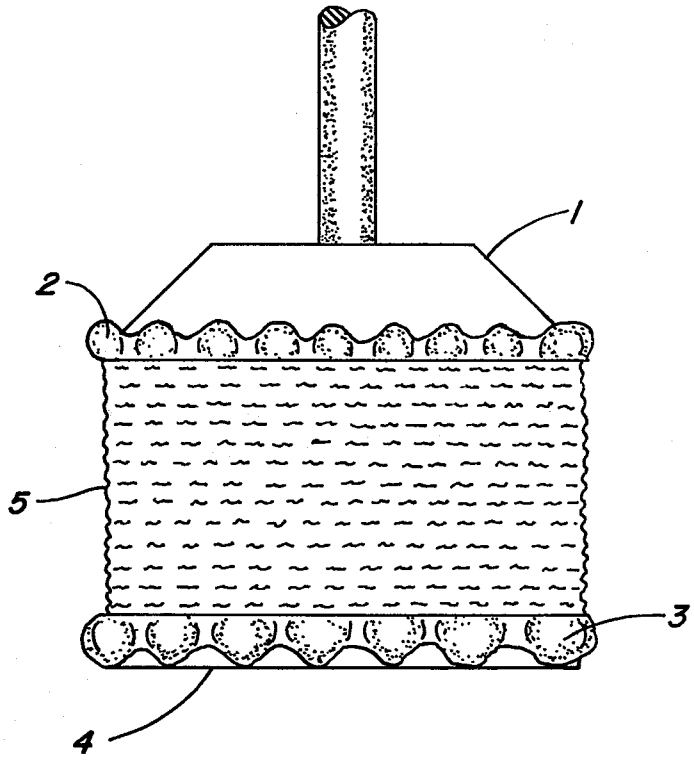
FIGS. 1 through 6 are schematic drawings of the method of this invention.

FIG. 2 shows the bale 5 of staple fiber being pressed between ram head 1 and platen 4 after being loaded and tamped into the bale press chamber which surrounds bale 5 but is not shown. Bale wrap 7 and bale wrap 3 are still in place dressing ram head 1 and covering platen 4.

Figure 3:
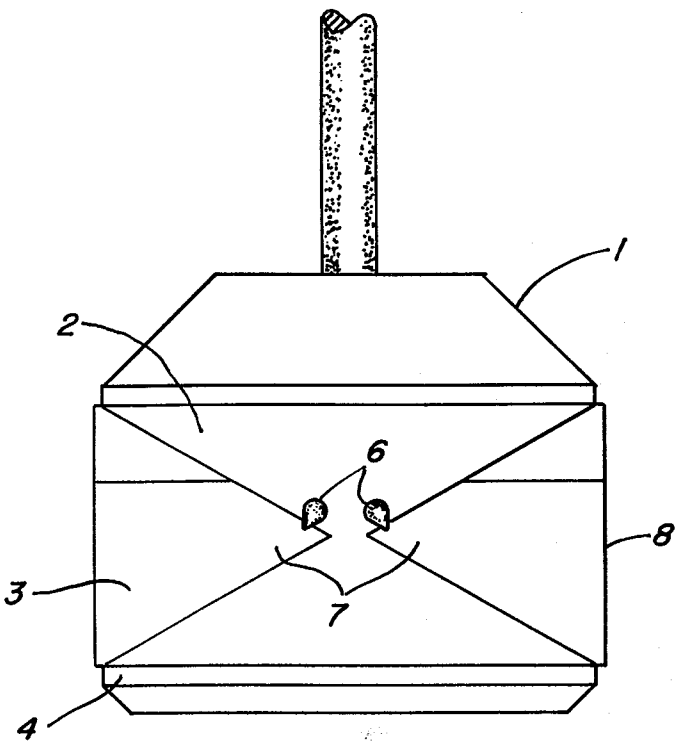

FIG. 3 shows the wrapped bale 8 covered with bale wrap 2 or 3 dressing ram head 1 and covering platen 4. Overlapping end flaps 7 of bale wrap are pinned with awl 6 as shown, straight and flattened.

Figure 4:
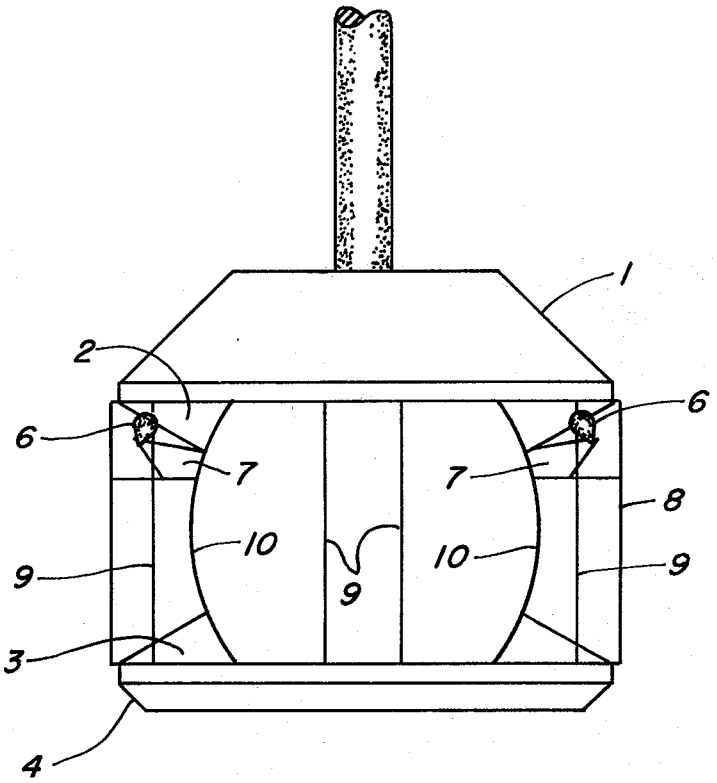

FIG. 4 shows wrapped bale 8 still pressed between ram head 1 and platen 4 covered with bale wrap 2 and 3, but wrapped with multiple wires 9 and 10 which have been joined to encircle the bale in a loose manner transverse to the longest dimension of the bale. Overlapping end flaps 7 are now in a new position, pinned by awl 6 drawn tight around and under loose encircling joined wire 10 and under wire 9, also still loose, near each end of bale 8, as shown, to bow wires 10.

Figure 5:
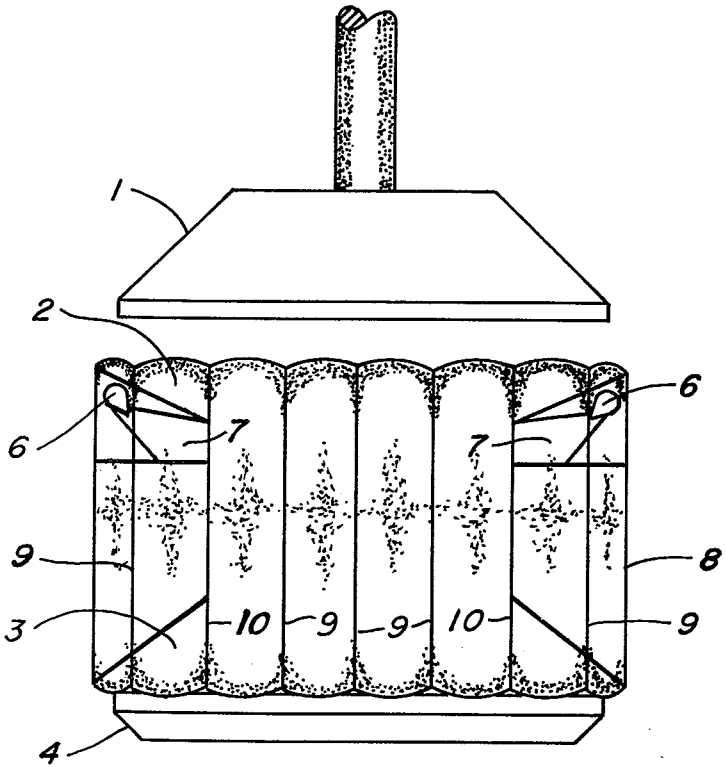

FIG. 5 shows ram head 1 released and covered bale 8 lying on platen 4. Wires 9 and 10 which were joined and formerly loose encircling the bale have become taut upon release of the ram head 1 to permit expansion of the staple fiber. Wires 10 which were formerly bowed are now straightened and taut and expert tension on overlapping end flaps 7 still pinned with awl 6.

Figure 6:
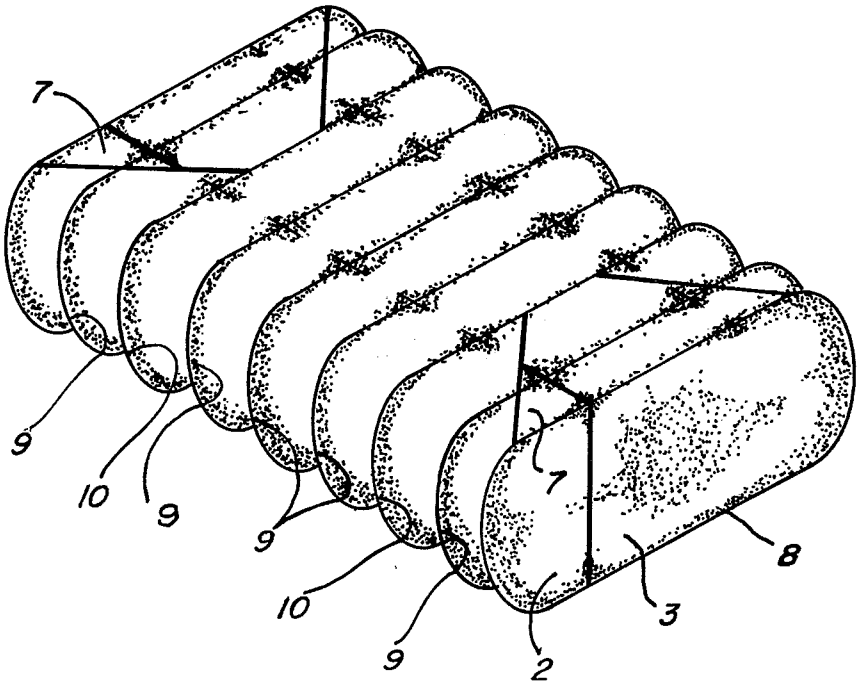

FIG. 6 shows completed bale 8 with awls 6 removed and end flaps 7 of bale wrap 2 and 3 held tight in position by wires 10, thus completing the method to cover bale 8. End flap 7 can be under end wires 9 to hold down the end portion of flap 7.

Details of the bale press chamber and other associated apparatus are shown in U.S. Pat. No. 3,152,409, previously incorporated by reference.

I claim:

1. In a method of wrapping a bale of staple fiber with bale wrap, the bale being shaped with a ram against a platen in a bale press chamber comprising dressing said ram head with said bale wrap while said bale press chamber is empty, covering said platen with said bale wrap while said bale press chamber is empty, said ram head and said platen being covered with sufficient bale wrap to overlap and cover the entire said bale and said bale wrap being position to overlap and cover the entire said bale loading and tamping said staple fiber into said bale press chamber, pressing said loaded tamped staple with said ram to compress said staple into a bale, covering the remaining sides of said bale with bale wrap, leaving overlapping end flaps of bale wrap, wrapping said covered bale with multiple wires, joining the wires, so that each wire encircles the bale in a loose manner, and releasing the ram, the improvement comprising before said ram is released, securing each of said bale wrap overlapping end flaps around one of said loose multiple encircling wires to bow said wire transverse to said wire axis, and pinning said wrap with a pinning means to hold said wire in the bowed position until said ram is released so that said wire straightens out on release of said ram to exert tension on said overlapping end flaps of said bale wrap thereby eliminating the need to fasten said overlapping end flaps of said bale wrap.

2. The method of claim 1 wherein said bale wrap overlapping end flaps are also each secured around one of said multiple encircling wires near each end of said bale.

3. The method of claim 2 wherein said pinning means is an awl.

4. The method of claim 1 wherein said wires encircle said bale transverse to the longest dimension of said bale.

5. The method of claim 1 wherein said bale wrap overlapping end flap also passes under the loose wire near the end of said bale after passing around said bowed wire.

* * * * *